US005279683A

United States Patent [19]

Okada et al.

[11] Patent Number: 5,279,683

[45] Date of Patent: Jan. 18, 1994

[54] METHOD OF PRODUCING HIGH-STRENGTH COLD-ROLLED STEEL SHEET SUITABLE FOR WORKING

[75] Inventors: Susumu Okada; Tojiro Ikeda; Susumu Satoh; Hideo Abe; Jun-ichi Mano, all of Chiba; Norio Ohta, Okayama, all of Japan

[73] Assignee: Kawasaki Steel Corporation, Kobe, Japan

[21] Appl. No.: 891,685

[22] Filed: May 29, 1992

Related U.S. Application Data

[63] Continuation-in-part of Ser. No. 686,698, Apr. 17, 1991, abandoned.

[30] Foreign Application Priority Data

Jun. 20, 1990 [JP] Japan ..... 2-159856

[51] Int. Cl.[5] ..... C21D 8/04

[52] U.S. Cl. ..... 148/546; 148/650; 148/505

[58] Field of Search ..... 148/546, 650, 533, 505

[56] References Cited

U.S. PATENT DOCUMENTS 4,576,657 3/1986 Satoh et al. ..... 148/12 C
4,857,117 8/1989 Sakata et al. ..... 148/12 F

FOREIGN PATENT DOCUMENTS 0193221 11/1984 Japan .

*Primary Examiner*—R. Dean
*Assistant Examiner*—Sikyin Ip
*Attorney, Agent, or Firm*—Dvorak and Traub

[57] ABSTRACT

A method of producing a high-strength cold-rolled steel sheet suitable for working uses which utilizes a steel material having the following composition: not more than 0.006 wt % of C, not more than 0.5 wt % of Si, not more than 2.0 wt % of Mn, and not less than 0.01 wt % but not more than 0.10 wt % of Ti, the Ti, C and N contents being determined to meet the condition of Ti>(48/12) C wt %+(48/14) N wt %, the steel also consisting essentially of not less than 0.0010 wt % but not more than 0.0100 wt % of Nb, not less than 0.0002 wt % but not more than 0.0020 wt % of B, not less than 0.03 wt % but not more than 0.20 wt % of P, not more than 0.03 wt % of S, not less than 0.010 wt % but not more than 0.100 wt % of Al, not more than 0.008 wt % of N, not more than 0.0045 wt % of O, and the balance substantially Fe and incidental inclusions. The steel material is cast and hot-rolled and then subjected to a cold rolling conducted at a sheet temperature not higher than 300° C. under such a condition that the sum of the rolling reductions of passes which meet the following condition between said sheet temperature (T °C.) and the strain rate $\dot{\epsilon}$ (S-1) is 50% or greater:

$$T \times \dot{\epsilon} \geqq 50{,}000^\circ\ C.\ S^{-1}$$

The steel sheet is then continuously annealed or galvannealed.

3 Claims, 1 Drawing Sheet

METHOD OF PRODUCING HIGH-STRENGTH COLD-ROLLED STEEL SHEET SUITABLE FOR WORKING

This application is a continuation-in-part of application Ser. No. 07/686,698 filed Apr. 17, 1991, now abandoned.

BACKGROUND OF THE INVENTION

1. Field of the Invention

The present invention relates to a method of producing a high-strength cold-rolled steel sheet which excels in workability and which is free from the problem of P segregation zone which is produced when a large amount of P is added for the purpose of enhancing the strength of the steel sheet.

In recent years, there is an increasing demand for high-strength steel sheets in the field of automobile production, in order to meet current requirements for reduction in the weight of automobiles to attain a higher fuel economy and for ensuring safety of drivers and passengers.

In modern automobile production, high-strength cold-rolled steel sheets are used not only for the inner panels but also for outer panels such as engine hoods, trunk lid and fenders. As a consequence, high-strength cold-rolled steel sheet is required to have an excellent workability.

Description of the Related Art

Hitherto, an art has been proposed in which, in order to improve workability of cold-rolled steel sheet, the carbon content of the steel is reduced and a carbonitride formers are added to the steel. For instance, Japanese Patent Laid-Open Publication No. 63-317648 discloses a cold-rolled steel sheet in which Ti, Nb and B are added to a low-carbon steel for the purpose of improving press-workability and spot-weldability. It has also been proposed to add strengthening elements such as P and Mn to the above-mentioned steel system. For instance, Japanese Patent Publication No. 61-11294 discloses a method of producing a high-strength steel sheet having a superior workability in which a steel enriched with P is continuously annealed after a cold rolling. Similarly, Japanese patent Publication No. 1-28817 discloses a method in which a steel enriched with P and Mn is continuously annealed to form a high-strength cold-rolled steel sheet.

These known methods exhibit disadvantages. The method disclosed in Japanese Patent Laid-Open No. 63-317648 cannot provide required strength, while the methods disclosed in Japanese Patent Publication Nos. 61-11294 and 1-28817 inevitably reduce workability although they exhibit improved strength. Under these circumstances, steel sheets superior both in strength and workability are strongly demanded.

SUMMARY OF THE INVENTION

An object of the present invention is to provide a method of producing, from a low-carbon steel having an extremely small carbon content, a high-strength cold-rolled steel sheet suitable for working, and more particularly a steel sheet having a superior workability, specifically a Lankford value ($\bar{r}$) of 1.8 or greater, a tensile strength T.S.) of 40 kgf/mm$^2$ or greater, an elongation (El) of 40% or greater, and a truncated-cone height of 40 mm or greater in the conical cup test.

To this end, according to the present invention, there is provided a method of producing a high-strength cold-rolled steel sheet suitable for working, comprising the steps of:

preparing a steel consisting essentially of not more than 0.02 wt % of C, not more than 1.0 wt % of Si, not more than 2.0 wt % of Mn, and not less than 0.01 wt % but not more than 0.10 wt % of Ti, the Ti, C and N contents being determined to meet the condition of Ti>(48/12) C wt %+(48/14) N wt %, said steel also consisting essentially of not less than 0.0010 wt % but not more than 0.0100 wt % of Nb, not less than 0.0002 wt % but not more than 0.0020 wt % of B, not less than 0.03 wt % but not more than 0.20 wt % of P, not more than 0.03 wt % of S, not less than 0.010 wt % but not more than 0.100 wt % of Al, not more than 0.008 wt % of N, not more than 0.0045 wt % of O, and the balance substantially Fe and incidental inclusions;

subjecting said steel to an ordinary casting and a subsequent hot-rolling;

subjecting the hot rolled steel to a cold rolling conducted at a sheet temperature not higher than 300° C. under such a condition that the sum of the rolling reductions of passes which meet the following condition between said sheet temperature (T ° C.) and the strain rate $\dot{\epsilon}$ ($S^{-1}$) is 50% or greater:

$$T \times \dot{\epsilon} \geqq 50{,}000^\circ\ C.\ S^{-1}$$

and subjecting the cold-rolled steel to a continuous annealing.

The sheet temperature T (°C.) is the temperature of the steel sheet at positions immediately downstream from the cold-rolling stands as measured by an infrared pyrometer, while the strain rate is calculated in accordance with the following formula:

$$\dot{\epsilon} = (2\pi \cdot n/60\sqrt{r}) \times (\sqrt{R/H_0}) \times \ln[1/(1-r)]$$

where, n represents the roll peripheral speed (rpm), $H_0$ represents the sheet thickness at inlet side, r represents the rolling reduction and R represents the radius of the roll.

DETAILED DESCRIPTION OF THE INVENTION

Figure 1:
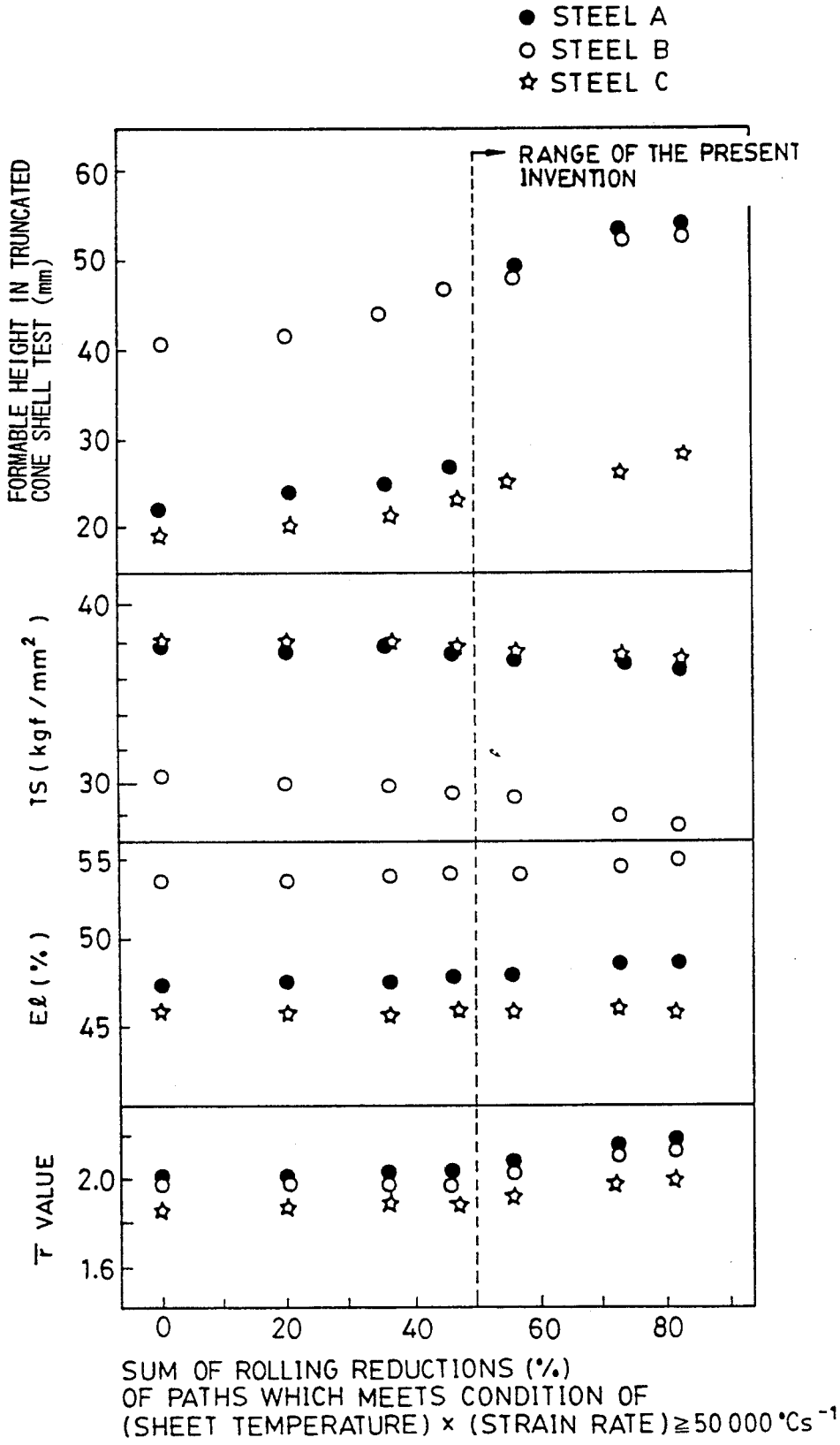
FIG. 1 is a graph which shows the relationship between rolling reductions and various characteristics of the steel sheet.

Through an intense study on improvement in workability of high strength cold-rolled steel sheet, the inventors have found that a high-strength cold-rolled steel sheet having a superior workability, specifically a Lankford value ($\bar{r}$) of 1.8 or greater, a tensile strength T.S.) of 40 kgf/mm$^2$ or greater, an elongation (El) of 40% or greater and a truncated-cone height of 40 mm or greater, can be obtained by selecting the strain-imparting condition in the cold rolling of a very-low-carbon steel which is rich in P and small in oxygen content.

The present invention is based upon the above-described discovery. A description will be given first of the reason why the condition is posed that the sum of the rolling reductions of passes which meet the condition of $T \times \dot{\epsilon} \geqq 50{,}000°$ C. $S^{-1}$ between the sheet temperature (T °C.) and the strain rate $\dot{\epsilon}$ ($S^{-1}$) is 50% or greater.

Three types of continuous-cast steel slabs A,B and C having the compositions shown in Table 1 were prepared by a converter.

TABLE 1

| Steel type Symbols | Contents (wt %) C | Si | Mn | P | S | Al | N | Ti | Nb | B | O | Ti* |
|---|---|---|---|---|---|---|---|---|---|---|---|---|
| A | 0.0025 | 0.1 | 0.25 | 0.075 | 0.008 | 0.055 | 0.0022 | 0.032 | 0.004 | 0.0012 | 0.0031 | 0.014 |
| B | 0.0025 | 0.01 | 0.22 | 0.015 | 0.007 | 0.048 | 0.0028 | 0.033 | 0.004 | 0.0011 | 0.0033 | 0.013 |
| C | 0.0024 | 0.01 | 0.25 | 0.077 | 0.008 | 0.067 | 0.0023 | 0.033 | 0.004 | 0.0011 | 0.0078 | 0.016 |

Ti* = Ti-(48/12) C-(48/14) N

Each slab was heated to 1250° C. and rough-rolled at a rolling reduction of 88%, followed by a hot finish-rolling at a rolling reduction of 88% (hot-rolling finish temperature: 880° C., coiling temperature: 500° C.) so as to be formed into a hot coil of 4.0 mm thick. Then, an ordinary cold rolling was effected at a rolling reduction of 82.5% so that the steel was formed into a sheet 0.7 mm thick. Subsequently, a continuous annealing was conducted at 810° C. followed by a temper rolling at a rolling reduction of 0.8% thereby producing a rolled steel sheet.

The cold rolling was conducted while varying the sheet temperature within the range of 30° C. to 300° C., while varying the reduction rate, i.e., the strain rate $\epsilon$ within the range between 10 $S^{-1}$ to 2,000 $S^{-1}$. The sheet temperature was controlled by varying the initial sheet temperature for the cold rolling and the flow rate of the cooling water.

The Lankford value ($\bar{r}$), elongation, tensile strength and truncated-cone height were measured for each of the sample steel sheets. The truncated-cone height, which is an index indicative of the workability approximating that in actual working was measured by a conical cup test conducted under the following conditions:

punch diameter: 80 mm Φ die diameter: 140 mm Φ wrinkle pressing force: 10 t

FIG. 1 shows the relationship between these measured values and the sum of the rolling reductions of the passes which meet the condition of the product of the cold rolling sheet temperature and the strain rate being not smaller than 50,000° C. $S^{-1}$.

As will be clearly understood from FIG. 1, the low-oxygen steel material A rich in P exhibited a tensile strength (T.S.) which is smaller than that of the steel B which has a small P content. In addition, when the sum of the rolling reductions of the passes having the product of the sheet temperature and the strain rate being 50,000 ° C. $S^{-1}$ or greater is 50% or above, the truncated-cone height indicative of the workability approximating that of actual working is remarkably improved to a value approximating that of the steel B which has a large tensile strength, while the elongation (El) and the Lankford value ($\bar{r}$) increase only slightly.

The steel C which is rich both in P and C does not show remarkable improvement in the properties indicative of the workability such as the Lankford value ($\bar{r}$), elongation (El) and the truncated-cone height.

In order to produce a high-strength cold-rolled steel sheet having superior workability, therefore, it is necessary to use a low-oxygen material having a large P content and that the cold rolling is conducted under a condition which meets the condition of the sum of the rolling reductions of the passes having the product of the sheet temperature and the strain rate being 50,000 ° C. $S^{-1}$ or greater is 50% or greater.

In conventional cold rolling of steel sheets, the sum of the rolling reductions of passes which meet the condition of the product of the sheet temperature and the strain rate being 50,000 ° C. $S^{-1}$ or greater is generally around 30%. In order to raise the value of the sum of the rolling reductions, it is necessary to take suitable measures such as an increase in the rolling speed, control of flow rate of cooling water, or elevation of the initial cold rolling temperature through a continuous change from the preceding step, which is usually pickling.

According to the invention, it is possible to obtain a high-strength cold-rolled steel having high workability by using a low-oxygen steel rich in P as the material and by conducting the cold rolling under the specific condition mentioned above. The reason why such superior workability is obtained has not been clarified yet.

The reason, however, is considered to reside in the following fact. In general, a microscopic observation of structure of a steel sheet rich in P exhibits a segregation zone in the thicknesswise central region of the sheet. In contrast, the steel produced by the method of the present invention does not exhibit such a degradation zone. This suggests that a certain effect which could not be produced by the conventional methods is caused on the segregation zone by the cold rolling condition peculiar to the invention. Although the reason is still unknown, it is considered that the cold rolling condition peculiar to the invention produces a uniform working effect in the thicknesswise direction so that a greater rolling effect is produced on the segregation zone as compared to known methods.

The segregation zone does not produce any substantial unfavorable effect on the elongation Lankford value ($\bar{r}$) which is measured in tensile test. In the actual use of the material, however, the segregation zone reduces the uniformity of the steel sheet in the thicknesswise direction and, hence, is considered to cause a reduction in the workability.

According to the method of the present invention, however, the cold rolling conducted under the specified condition produces a working effect which serves to break the segregation zone, so that the uniformity of the structure in the thicknesswise direction of the steel sheet is improved so as to improve the workability as confirmed through the conical cup test which simulates the actual condition of use. When the oxygen content in the steel is large, however, the large quantity of the inclusions impedes the cold-rolling straining of P in the segregation zone so as to reduce the effect of improving the workability.

A description will now be given of the reason for limitation of the chemical composition of the steel. C: C serves, when added to the steel material together with Ti, to strengthens the steel without impairing workability. In order to obtain an excellent workability, therefore, the C content is preferably below 0.006 wt %.

Si: The upper limit of Si content is set to be 1.0 wt %, since the drawing characteristic of the steel is impaired when the Si content exceeds 1.0 wt %.

Mn: This element is effective in raising the strength without impairing the drawing characteristic. Addition of this element in an excessive amount reduces the drawing characteristic so that the Mn content is limited to be not more than 2.0 wt %.

Ti: This element serves to fix C and N in the steel so as to prevent deterioration of the material caused by solid solution of C. In addition, this element impedes formation of BN so as to prevent reduction in the amount of solid solution of B. In order to obtain an appreciable effect, therefore, this element should be added in an amount exceeding the sum of the C equivalent [(48/12) C wt %] and N equivalent [(48/14) N wt %]. However, Ti content below 0.01 wt % is too low to enable Ti to produce any appreciable effect. On the other hand, addition of Ti in excess of 0.10 wt % reduces the strength. Therefore, the Ti content should be not less than 0.01 wt % and not more that 0.10 wt % and be determined to exceed the value of [(48/12) C wt %+(48/14) N wt %].

Nb: This element is essential since it improves the Lankford value ($\bar{r}$) and strengthens the steel when added together with B. Nb content below 0.0010 wt %, however, does not produce any remarkable effect. On the other hand, addition of Nb in excess of 0.0100 wt % reduces the workability so as to impair the balance between strength and workability. The Nb content, therefore, is determined to be not less than 0.0010 wt % but not more than 0.0100 wt %. When the steel is bound to be a deep drawing, however, the Nb content is preferably not less than 0.0075 wt %.

B: This element is indispensable since it improves the strength when added together with Nb. B content below 0.0002 wt % does not produce any remarkable effect, while addition of B in excess of 0.002 wt % seriously degrades the material. The B content, therefore, is determined to be not less than 0.0002 wt % but not more than 0.002 wt %. Preferably, B content is determined to be not more than 0.0012 wt %.

P: This element is an important strengthening element. The effect of this element is remarkable particularly when the content is 0.03 wt % or more. However, addition of P in excess of 0.20 wt % deteriorates the balance between strength and workability and, in addition, causes an undesirable effect on the brittleness of the steel. The content of P, therefore, is determined to be not less than 0.03 wt % but not more than 0.20 wt %, more preferably not less than 0.04 wt % but not more than 0.15 wt %.

S: A reduction is S content in the steel is necessary for improving deep drawability. However, the undesirable effect on the workability produced by S is not so serious when the S content is reduced down below 0.03 wt %. The upper limit of the S content is therefore set to be 0.03 wt %.

Al: This element is necessary for improving yield of carbonitride formers through deoxidation and for eliminating generation of surface defects caused by formation of $TiO_2$. The effect of addition of this element, however, is not appreciable when the content is below 0.010 wt %. In addition, the deoxidation effect is saturated when the Al content is increased beyond 0.10 wt %. In addition, increase in the Al content tends to cause surface defect due to generation of $Al_2O_3$. The Al content, therefore, is determined to be not less than 0.01 wt % but not more than 0.10 wt %.

N: This element degrades deep drawability of the steel and, in addition, reduces anti-secondary working embrittlement due to bonding with B, unless it is fixed by Ti. Thus, a greater N content uneconomically requires greater amount of Ti. The N content, therefore, should be not more than 0.0008 wt %, preferably not more than 0.0006 wt %.

O: In order to improve workability which is the critical requirement in the present invention, it is necessary to reduce O concentration. When the O content exceeds 0.0045 wt %, the cold-rolling straining to the segregation zone is impeded by a large amount of inclusions as explained before. As a consequence, the effect of improving workability produced by the cold straining is impaired and, in addition, an effect which is not negligible is caused on the brittleness. For this reason, the upper limit of O content is set to be 0.0045 wt %, preferably to 0.004 wt %. Reduction in the oxygen content in the steel is effected by controlling the length of time of killed treatment in degassing step in ordinary steel making process.

A description will now be given of the preferred condition for the preparation of the starting steel material having the above-described composition and preferred condition for the production of a steel sheet from the starting steel material.

The steel making process and a subsequent hot rolling can be carried out in the same manner as the known process, except that the oxygen content is reduced by the method described above.

A material having satisfactory properties can be obtained when the coiling temperature of the steel after the hot rolling falls within the range of ordinary process, e.g., between 400° C. and 700° C. Thus, it is not necessary to employ a specifically high coiling temperature. Rather, it is preferred that the coiling temperature is comparatively low, e.g., 550° C. or less, in order to avoid any deterioration in pickling property caused by the thickening of scale and to prevent excessive softening of the product.

The cold rolling may be conducted by using an ordinary cold rolling mill, provided that the aforementioned cold rolling condition is met. Namely, it is necessary that the sum of the rolling reduction of passes which meets the condition of the product of the sheet temperature and the strain rate being not smaller than 50,000° C. $S^{-1}$ is 50% or greater. There is no restriction in the total rolling reduction, i.e., the sum of the reductions of all passes employed, provided that the above-described condition is met.

As stated before, the cold rolling sheet temperature has to be not higher than 300° C. because a cold rolling at higher temperature causes concentration of shear deformation to the surface region of the steel sheet, making it difficult to work the central segregation zone.

When the steel having the described composition is annealed by batch-type box annealing method, the steel tends to be come brittle due to grain boundary segregation of P due to high P content, particularly when the cooing rate is small. In order to obviate this problem, according to the present invention, a continuous annealing method which enables rapid heating and cooling. The annealing temperature, however, may be not lower than recrystallization temperature but not higher than $A_3$ transformation temperature, as in the case of ordinary steel annealing process.

The temper rolling subsequent to the annealing may be effected under ordinary steel tempering condition with a rolling reduction corresponding to the sheet thickness (mm), for the purpose of, for example, obtaining optimum shape of the sheet.

EXAMPLE

Ten types of steels, including 7 types meeting the composition condition of the invention and 3 types as reference examples, were prepared in a converter and were continuously cast into slabs. Each slab was hot-rolled to form a hot coil of 3,0 mm thick and cold-rolled to a thickness of 0.72 mm. Subsequently, a continuous annealing was conducted under ordinary condition. Then, the steel sheets other than the type No. 3 were subjected to a temper rolling with a rolling reduction of 0.7%, whereby 10 types of steel sheets including one which has not been subjected to temper rolling were prepared.

The roll used in the cold rolling had a diameter of 600 mm. The cold rolling speed was 1500 to 2500 m/min at the outlet side of the cold rolling stand.

Among ten types of steel, each of type Nos. 1 and 2 were subjected to three different production conditions with different cold-rolling and continuous annealing conditions, so that three samples were produced for each of the steel type Nos. 1 and 2. Similarly, two samples were prepared from the steel type No. 1 through different production conditions. Only one sample was prepared for each of the remainder steel types.

Table 3 shows the hot-rolling and continuous annealing conditions, Table 4 shows the cold rolling conditions and Table 5 shows the result of examination of the properties of the cold-rolled sample steel sheets.

TABLE 2

| Steel type No. | Class | Contents (wt %) C | Si | Mn | P | S | Al | N | Ti | Nb | B | O | Ti* |
|---|---|---|---|---|---|---|---|---|---|---|---|---|---|
| 1 | Invention | 0.0021 | 0.01 | 0.11 | 0.055 | 0.008 | 0.040 | 0.0025 | 0.032 | 0.0034 | 0.0008 | 0.0025 | 0.015 |
| 2 | Invention | 0.0026 | 0.02 | 0.45 | 0.073 | 0.012 | 0.039 | 0.0027 | 0.042 | 0.0024 | 0.0007 | 0.0019 | 0.022 |
| 3 | Invention | 0.0020 | 0.03 | 0.09 | 0.130 | 0.006 | 0.081 | 0.0031 | 0.072 | 0.0044 | 0.0010 | 0.0037 | 0.053 |
| 4 | Invention | 0.0029 | 0.02 | 0.33 | 0.084 | 0.005 | 0.036 | 0.0015 | 0.036 | 0.0070 | 0.0009 | 0.0033 | 0.019 |
| 5 | Invention | 0.0056 | 0.25 | 0.29 | 0.085 | 0.018 | 0.024 | 0.0043 | 0.051 | 0.0020 | 0.0006 | 0.0028 | 0.014 |
| 6 | Comp. Ex. | 0.0080 | 0.02 | 0.34 | 0.062 | 0.027 | 0.065 | 0.0051 | 0.057 | 0.0099 | 0.0016 | 0.0036 | 0.008 |
| 7 | Comp. Ex. | 0.0035 | 0.76 | 1.54 | 0.042 | 0.017 | 0.035 | 0.0021 | 0.061 | 0.0048 | 0.0011 | 0.0030 | 0.040 |
| 8 | Comp. Ex. | 0.0034 | 0.01 | 0.34 | 0.060 | 0.015 | 0.050 | 0.0022 | 0.045 | 0.0032 | 0.0012 | 0.0054 | 0.024 |
| 9 | Comp. Ex. | 0.0030 | 0.02 | 0.24 | 0.088 | 0.010 | 0.060 | 0.0019 | 0.015 | 0.0025 | 0.0010 | 0.0034 | −0.004 |
| 10 | Comp. Ex. | 0.0021 | 0.05 | 0.33 | 0.068 | 0.022 | 0.061 | 0.0034 | 0.038 | 0.0250 | 0.0005 | 0.0037 | 0.018 |

Comp. Ex. = Comparative Example
Ti* = Ti-(48/12) C-(48/14) N

TABLE 3

| Sample No. | Steel type No. | Class | Slab heating temp. (°C.) | Hot-roll finishing temp. (°C.) | Coiling temp. (°C.) | CR* | Continuous annealing condition: Re-crystallization temp. (°C.) | Max. heating temp. (°C.) |
|---|---|---|---|---|---|---|---|---|
| 1 | 1 | Invention | 1200 | 920 | 480 | 77 | 770 | 790 |
| 2 | 1 | Comp. Ex. | 1200 | 920 | 480 | 34 | 770 | 790 |
| 3 | 1 | Invention | 1200 | 920 | 480 | 68 | 770 | *1 790 |
| 4 | 2 | Invention | 1150 | 910 | 500 | 61 | 780 | 810 |
| 5 | 2 | Comp. Ex. | 1150 | 910 | 500 | 40 | 780 | 810 |
| 6 | 2 | Comp. Ex. | 1150 | 910 | 500 | *2 118 | 780 | 810 |
| 7 | 3 | Invention | 1100 | 900 | 550 | 62 | 800 | 850 |
| 8 | 4 | Invention | 1250 | 900 | 550 | 62 | 770 | 780 |
| 9 | 4 | Comp. Ex. | 1250 | 900 | 550 | 26 | 770 | 780 |
| 10 | 5 | Invention | 1200 | 880 | 600 | 55 | 750 | 880 |
| 11 | 6 | Comp. Ex. | 1200 | 850 | 650 | 65 | 730 | 850 |
| 12 | 7 | Comp. Ex. | 1250 | 890 | 550 | 51 | 760 | 850 |
| 13 | 8 | Comp. Ex. | 1200 | 900 | 550 | 63 | 770 | 800 |
| 14 | 9 | Comp. Ex. | 1200 | 900 | 550 | 65 | 770 | 800 |
| 15 | 10 | Comp. Ex. | 1200 | 900 | 550 | 63 | 770 | 800 |

Comp. Ex. = Comparative Example
CR*: Sum of rolling reductions of paths which meets condition of sheet temp. (T) × strain rate($\dot{\epsilon}$) ≧ 50,000° C.$s^{-1}$
*1: Continuous hot-dip galvanizing line used
*2: Sheet temp. in cold-rolling exceeded 300° C.

TABLE 4 (1)

| Sample No. | Steel type No. | Class | Items | Stand No. 1 | 2 | 3 | 4 | 5 | 6 | CR* (%) |
|---|---|---|---|---|---|---|---|---|---|---|
| 1 | 1 | Invention | Rolling reduction (%) | 37 | 47 | 24 | 5 | — | — | 76 |
| | | | T (°C.) | 50 | 100 | 130 | 140 | — | — | — |
| | | | $\dot{\epsilon}$ ($s^{-1}$) | 400 | 1,170 | 1,280 | 650 | — | — | — |
| | | | T × $\dot{\epsilon}$ (°C.$s^{-1}$) | 20,000 | 117,000 | 166,000 | 91,000 | — | — | — |

TABLE 4 (1)-continued

| Sample No. | Steel type No. | Class | Items | Stand No. 1 | 2 | 3 | 4 | 5 | 6 | CR* (%) |
|---|---|---|---|---|---|---|---|---|---|---|
| 2 | 1 | Comp. Ex. | Rolling reduction (%) | 57 | 19 | 19 | 15 | — | — | 34 |
| | | | T (°C.) | 45 | 75 | 100 | 120 | — | — | — |
| | | | $\dot{\epsilon}$ ($s^{-1}$) | 750 | 620 | 850 | 980 | — | — | — |
| | | | T × $\dot{\epsilon}$ (°C.$s^{-1}$) | 34,000 | 47,000 | 85,000 | 117,000 | — | — | — |
| 3 | 1 | Invention | Rolling reduction (%) | 45 | 42 | 18 | 8 | — | — | 68 |
| | | | T (°C.) | 55 | 90 | 115 | 130 | — | — | — |
| | | | $\dot{\epsilon}$ ($s^{-1}$) | 430 | 960 | 850 | 630 | — | — | — |
| | | | T × $\dot{\epsilon}$ (°C.$s^{-1}$) | 24,000 | 87,000 | 98,000 | 82,000 | — | — | — |
| 4 | 2 | Invention | Rolling reduction (%) | 17 | 40 | 40 | 17 | 4 | — | 61 |
| | | | T (°C.) | 50 | 80 | 100 | 120 | 130 | — | — |
| | | | $\dot{\epsilon}$ ($s^{-1}$) | 160 | 520 | 1,120 | 960 | 500 | — | — |
| | | | T × $\dot{\epsilon}$ (°C.$s^{-1}$) | 8,000 | 42,000 | 112,000 | 115,000 | 65,000 | — | — |
| 5 | 2 | Comp. Ex. | Rolling reduction (%) | 48 | 29 | 14 | 14 | 12 | — | 40 |
| | | | T (°C.) | 30 | 60 | 90 | 120 | 140 | — | — |
| | | | $\dot{\epsilon}$ ($s^{-1}$) | 610 | 810 | 690 | 860 | 990 | — | — |
| | | | T × $\dot{\epsilon}$ (°C.$s^{-1}$) | 18,000 | 48,000 | 62,000 | 103,000 | 139,000 | — | — |
| 6 | 2 | Comp. Ex. | Rolling reduction (%) | 43 | 35 | 18 | 11 | 10 | — | 117* |
| | | | T (°C.) | 350 | 350 | 350 | 360 | 360 | — | — |
| | | | $\dot{\epsilon}$ ($s^{-1}$) | 310 | 530 | 520 | 480 | 540 | — | — |
| | | | T × $\dot{\epsilon}$ (°C.$s^{-1}$) | 109,000 | 186,000 | 181,000 | 174,000 | 194,000 | — | — |
| 7 | 3 | Invention | Rolling reduction (%) | 47 | 44 | 18 | 3 | — | — | 62 |
| | | | T (°C.) | 55 | 90 | 110 | 120 | — | — | — |
| | | | $\dot{\epsilon}$ ($s^{-1}$) | 480 | 1,110 | 960 | 390 | — | — | — |
| | | | T × $\dot{\epsilon}$ (°C.$s^{-1}$) | 27,000 | 100,000 | 106,000 | 47,000 | — | — | — |

Comp. Ex. = Comparative Example
*Sheet temp. 300° C. or above.

TABLE 4 (2)

| Sample No. | Steel type No. | Class | Items | Stand No. 1 | 2 | 3 | 4 | 5 | 6 | CR* (%) |
|---|---|---|---|---|---|---|---|---|---|---|
| 8 | 4 | Invention | Rolling reduction (%) | 33 | 28 | 28 | 19 | 12 | 4 | 63 |
| | | | T (°C.) | 40 | 70 | 70 | 120 | 130 | 140 | — |
| | | | $\dot{\epsilon}$ ($s^{-1}$) | 350 | 520 | 840 | 960 | 910 | 570 | — |
| | | | T × $\dot{\epsilon}$ (°C.$s^{-1}$) | 14,000 | 36,000 | 59,000 | 116,000 | 119,000 | 79,000 | — |
| 9 | 4 | Comp. Ex. | Rolling reduction (%) | 33 | 25 | 23 | 17 | 17 | 9 | 26 |
| | | | T (°C.) | 30 | 50 | 70 | 80 | 90 | 100 | — |
| | | | $\dot{\epsilon}$ ($s^{-1}$) | 250 | 340 | 490 | 560 | 730 | 610 | — |
| | | | T × $\dot{\epsilon}$ (°C.$s^{-1}$) | 8,000 | 17,000 | 34,000 | 45,000 | 66,000 | 61,000 | — |
| 10 | 5 | Invention | Rolling reduction (%) | 33 | 33 | 30 | 18 | 8 | — | 56 |
| | | | T (°C.) | 40 | 80 | 120 | 140 | 150 | — | — |
| | | | $\dot{\epsilon}$ ($s^{-1}$) | 340 | 600 | 970 | 1020 | 760 | — | — |
| | | | T × $\dot{\epsilon}$ (°C.$s^{-1}$) | 13,000 | 48,000 | 117,000 | 143,000 | 113,000 | — | — |
| 11 | 6 | Comp. Ex. | Rolling reduction (%) | 48 | 39 | 13 | 8 | 5 | — | 65 |
| | | | T (°C.) | 35 | 70 | 100 | 110 | 120 | — | — |
| | | | $\dot{\epsilon}$ ($s^{-1}$) | 490 | 920 | 650 | 610 | 520 | — | — |
| | | | T × $\dot{\epsilon}$ (°C.$s^{-1}$) | 17,000 | 65,000 | 65,000 | 67,000 | 62,000 | — | — |
| 12 | 7 | Comp. Ex. | Rolling reduction (%) | 33 | 35 | 35 | 9 | 6 | — | 50 |
| | | | T (°C.) | 40 | 70 | 100 | 130 | 140 | — | — |
| | | | $\dot{\epsilon}$ ($s^{-1}$) | 350 | 690 | 1290 | 790 | 720 | — | — |
| | | | T × $\dot{\epsilon}$ (°C.$s^{-1}$) | 14,000 | 48,000 | 129,000 | 102,000 | 101,000 | — | — |
| 13 | 8 | Comp. Ex. | Rolling reduction (%) | 33 | 28 | 24 | 21 | 14 | 4 | 63 |
| | | | T (°C.) | 40 | 60 | 80 | 100 | 120 | 130 | — |
| | | | $\dot{\epsilon}$ ($s^{-1}$) | 310 | 460 | 650 | 860 | 870 | 500 | — |
| | | | T × $\dot{\epsilon}$ (°C.$s^{-1}$) | 12,000 | 27,000 | 52,000 | 86,000 | 104,000 | 65,000 | — |
| 14 | 9 | Comp. Ex. | Rolling reduction (%) | 48 | 39 | 13 | 8 | 5 | — | 65 |
| | | | T (°C.) | 35 | 70 | 100 | 110 | 120 | — | — |
| | | | $\dot{\epsilon}$ ($s^{-1}$) | 490 | 920 | 650 | 610 | 520 | — | — |
| | | | T × $\dot{\epsilon}$ (°C.$s^{-1}$) | 17,000 | 65,000 | 65,000 | 67,000 | 62,000 | — | — |
| 15 | 10 | Comp. Ex. | Rolling reduction (%) | 33 | 28 | 24 | 21 | 14 | 4 | 63 |
| | | | T (°C.) | 40 | 60 | 80 | 100 | 120 | 130 | — |
| | | | $\dot{\epsilon}$ ($s^{-1}$) | 310 | 460 | 650 | 860 | 870 | 500 | — |

TABLE 4 (2)-continued

| Sample No. | Steel type No. | Class | Items | Stand No. 1 | 2 | 3 | 4 | 5 | 6 | CR* (%) |
|---|---|---|---|---|---|---|---|---|---|---|
| | | | $T \times \dot{\epsilon}$ (°C.s$^{-1}$) | 12,000 | 27,000 | 52,000 | 86,000 | 104,000 | 65,000 | — |

CR*: Sum of rolling reductions of paths which meets condition of sheet temp. (T) × strain rate ($\dot{\epsilon}$) ≧ 50,000° C.s$^{-1}$
Comp. Ex. = Comparative Example

TABLE 5

| Sample No. | Steel type No. | Class | Y.S. (kgf/mm$^2$) | T.S. (kgf/mm$^2$) | El. (%) | T.S. + El. | $\bar{r}$ value | Truncated-cone height (mm) |
|---|---|---|---|---|---|---|---|---|
| 1 | 1 | Invention | 20.0 | 35.4 | 50.3 | 85.7 | 2.2 | 55 |
| 2 | 1 | Comp. Ex. | 20.4 | 35.4 | 50.5 | 85.9 | 2.2 | 30 |
| 3 | 1 | Invention | 20.6 | 36.2 | 49.6 | 85.8 | 2.1 | 51 |
| 4 | 2 | Invention | 21.2 | 38.6 | 47.5 | 86.1 | 2.2 | 55 |
| 5 | 2 | Comp. Ex. | 22.5 | 38.5 | 47.5 | 86.0 | 2.2 | 25 |
| 6 | 2 | Comp. Ex. | 22.7 | 38.8 | 45.5 | 84.3 | 2.0 | 20 |
| 7 | 3 | Invention | 25.8 | 45.2 | 41.2 | 86.4 | 2.1 | 55 |
| 8 | 4 | Invention | 20.7 | 36.5 | 49.2 | 85.7 | 2.3 | 50 |
| 9 | 4 | Comp. Ex. | 20.9 | 36.1 | 49.1 | 85.2 | 2.2 | 33 |
| 10 | 5 | Invention | 23.3 | 40.5 | 45.3 | 85.8 | 2.1 | 52 |
| 11 | 6 | Comp. Ex. | 28.1 | 48.5 | 36.4 | 85.1 | 2.0 | 45 |
| 12 | 7 | Comp. Ex. | 24.9 | 54.3 | 33.4 | 87.7 | 2.0 | 53 |
| 13 | 8 | Comp. Ex. | 21.5 | 35.4 | 49.4 | 84.8 | 2.0 | 35 |
| 14 | 9 | Comp. Ex. | 26.4 | 34.8 | 42.1 | 76.9 | 1.6 | 20 |
| 15 | 10 | Comp. Ex. | 22.0 | 36.1 | 43.1 | 79.2 | 2.0 | 30 |

Comp. Ex. = Comparative Example

From Table 5, it will be understood that the sample Nos. 2, 5, 6, 9, 13, 14 and 15 as reference examples showed comparatively small values of truncated-cone height ranging from 20 mm to 35 mm. In contrast, other samples which meet the condition of the invention showed large values of truncated-cone height ranging from 45 mm to 55 mm, thus proving superior workability.

Sample No. 3 was subjected to a galvannealing instead of the continuous annealing. This galvannealed steel sheet also showed excellent workability as in the cases of other samples meeting the conditions of the invention.

Sample No. 6 was cold-rolled at a cold-rolling sheet temperature exceeding 300° C., although the sum of the rolling reductions of the passes having the product of the sheet temperature and the strain rate exceeding 50,000° C. S$^{-1}$ was greater than 50%. Consequently, this sample showed a too small workability which was 20 mm in terms of truncated-cone height.

As will be understood from the foregoing description, a method has been established by the present invention which enables production of a high-strength cold-rolled steel sheet having superior workability by processing a low-oxygen low-carbon steel rich in P under specific cold-rolling conditions. The cold-rolled steel sheet produced by the method of the invention is suitable for use as a material of products which are produced through press-forming, bulging, deep-drawing and other plastic works.

What is claimed is:

1. A method of producing a high-strength cold-rolled steel sheet suitable for working, comprising the steps of:

preparing a steel consisting essentially of not more than 0.006 wt % of C, not more than 0.5 wt % of Si, not more than 2.0 wt % of Mn, and not less than 0.01 wt % but not more than 0.10 wt % of Ti, the Ti, C and N contents being determined to meet the condition of Ti<(48/12) C wt %+(48/14) N wt %, said steel also comprising not less than 0.0010 wt % but not more than 0.0100 wt % of Nb, not less than 0.0002 wt % but not more than 0.0020 wt % of B, not less than 0.03 wt % but not more than 0.20 wt % of P, not more than 0.03 wt % of S, not less than 0.010 wt % but not more than 0.100 wt % of Al, not more than 0.008 wt % of N, not more than 0.0045 wt % of O, and the balance substantially Fe and incidental inclusions;

subjecting said steel to an ordinary casting, reheating at not less than 1,100° C. but not higher than 1,250° C., and a subsequent hot-rolling;

subjecting the hot-rolled steel to a cold rolling conducted at a sheet temperature not higher than 300° C. under such a condition that the sum of the rolling reductions of passes which meet the following conditions between said sheet temperature T(°C.) and the strain rate $\dot{\epsilon}$ (S$^{-1}$) is 50% of greater:

$T \times \dot{\epsilon} \geqq 50{,}000°\ C.\ S^{-1}$ and subjecting the cold-rolled steel to a continuous annealing, whereby a high-tension cold-rolled steel sheet is obtained having superior workability and which simultaneously exhibits both a Lankford value ($\bar{r}$) not lower than 2.1, and a tensile strength (T.S.) not lower than 40 kfg/mm$^2$, an elongation (El) not less than 40% and a coning height not smaller than 40 mm.

2. A method according to claim 1, wherein the P content is not less than 0.04 wt % and not more than 0.15 wt % and the O content is not more than 0.0040 wt %.

3. A method according to claim 1, wherein galvannealing is conducted in place of said continuous annealing.

* * * * *